US009238950B2

(12) United States Patent
Schaeper

(10) Patent No.: US 9,238,950 B2
(45) Date of Patent: Jan. 19, 2016

(54) BLOWOUT PREVENTER WITH PACKER ASSEMBLY AND METHOD OF USING SAME

(71) Applicant: National Oilwell Varco, L.P., Houston, TX (US)

(72) Inventor: Gary R. Schaeper, Tomball, TX (US)

(73) Assignee: National Oilwell Varco, L.P., Houston, TX (US)

( * ) Notice: Subject to any disclaimer, the term of this patent is extended or adjusted under 35 U.S.C. 154(b) by 12 days.

(21) Appl. No.: 14/152,583

(22) Filed: Jan. 10, 2014

(65) Prior Publication Data

US 2015/0198003 A1 Jul. 16, 2015

(51) Int. Cl.
*E21B 33/06* (2006.01)

(52) U.S. Cl.
CPC ..... *E21B 33/062* (2013.01)

(58) Field of Classification Search
CPC ..... E21B 33/062
See application file for complete search history.

(56) References Cited

U.S. PATENT DOCUMENTS

| | | | | |
|---|---|---|---|---|
| 2,193,110 | A | | 3/1940 | Penick et al. |
| 2,194,256 | A | | 3/1940 | Allen |
| 2,749,078 | A | | 6/1956 | Losey |
| 3,102,709 | A | | 9/1963 | Allen |
| 3,272,222 | A | | 9/1966 | Allen |
| 3,915,426 | A | | 10/1975 | Lerouax |
| 4,229,012 | A | | 10/1980 | Williams, III |
| 4,265,424 | A | | 5/1981 | Jones |
| 4,323,256 | A | | 4/1982 | Miyagishima et al. |
| 4,332,367 | A | | 6/1982 | Nelson |
| 4,398,729 | A | | 8/1983 | Bishop et al. |
| 4,428,592 | A | | 1/1984 | Shaffer |
| 4,444,404 | A | | 4/1984 | Parks, Jr. |
| 4,456,215 | A | | 6/1984 | Bishop et al. |
| 4,506,858 | A | | 3/1985 | Gentry |
| 4,541,639 | A | * | 9/1985 | Williams, III ..... 277/325 |
| 4,553,730 | A | | 11/1985 | Vicic |
| 4,647,002 | A | | 3/1987 | Crutchfield |
| 4,712,620 | A | | 12/1987 | Lim et al. |

(Continued)

FOREIGN PATENT DOCUMENTS

WO 2013002971 1/2013

OTHER PUBLICATIONS

"Shaffer 13 ⅝"—10,000 PSI LXT Ram Bop", National Oilwell Varco, 2011, 2 pages.

(Continued)

*Primary Examiner* — Kevin Murphy
*Assistant Examiner* — Daphne M Barry
(74) *Attorney, Agent, or Firm* — JL Salazar Law Firm

(57) ABSTRACT

A packer assembly for a blowout preventer for sealing a wellbore is provided. The blowout preventer has ram blocks with a front face engageable with another ram block. The packer assembly is carried by each ram block and includes a support, a face packer having a sealing surface engageable with the face packer of an adjacent ram block, and a pair of plates positionable about the face packer. The plates include an extended plate and a support plate with the face packer therebetween. The extended plate protrudes from the ram block a distance beyond the support plate such that, when the ram blocks are moved together, the extended plate makes contact with the extended plate of an adjacent ram block before the support plates make contact with the adjacent ram block whereby a sealing pressure between the face packers of the adjacent ram blocks is maintained.

23 Claims, 12 Drawing Sheets

(56) References Cited

U.S. PATENT DOCUMENTS

| | | | | | |
|---|---|---|---|---|---|
| 5,005,802 | A * | 4/1991 | McWhorter et al. | 251/1.3 | |
| 5,009,289 | A * | 4/1991 | Nance | 188/67 | |
| 5,025,708 | A | 6/1991 | Smith et al. | | |
| 5,064,164 | A * | 11/1991 | Le | E21B 33/062 251/1.1 | |
| 5,125,620 | A | 6/1992 | Young | | |
| 5,251,870 | A * | 10/1993 | Ward | 251/1.3 | |
| 5,294,088 | A * | 3/1994 | McWhorter et al. | 251/1.3 | |
| 5,575,452 | A | 11/1996 | Whitby et al. | | |
| 5,603,481 | A * | 2/1997 | Parker et al. | 251/1.3 | |
| 5,735,502 | A | 4/1998 | Levett et al. | | |
| 5,833,208 | A | 11/1998 | Lee, Jr. | | |
| 5,897,094 | A | 4/1999 | Brugman et al. | | |
| 5,944,110 | A | 8/1999 | Watts et al. | | |
| 6,006,647 | A * | 12/1999 | Van Winkle | 91/41 | |
| 6,089,526 | A | 7/2000 | Olson | | |
| 6,173,770 | B1 | 1/2001 | Morrill | | |
| 6,296,225 | B1 | 10/2001 | Watts | | |
| 6,330,918 | B1 | 12/2001 | Hosie et al. | | |
| 6,367,804 | B1 | 4/2002 | Watts | | |
| 6,394,460 | B1 * | 5/2002 | Leggett | E21B 33/062 277/324 | |
| 6,857,634 | B2 | 2/2005 | Araujo | | |
| 6,974,135 | B2 | 12/2005 | Melancon et al. | | |
| 7,051,989 | B2 | 5/2006 | Springett et al. | | |
| 7,234,530 | B2 | 6/2007 | Gass | | |
| 7,264,058 | B2 * | 9/2007 | Fossli | 166/367 | |
| 7,464,765 | B2 * | 12/2008 | Isaacks et al. | 166/378 | |
| 7,798,466 | B2 | 9/2010 | Springett et al. | | |
| 7,967,299 | B2 | 6/2011 | McClanahan | | |
| 8,020,626 | B2 | 9/2011 | Francis et al. | | |
| 8,157,018 | B2 | 4/2012 | Francis et al. | | |
| 8,281,856 | B2 | 10/2012 | Jahn et al. | | |
| 8,297,347 | B2 | 10/2012 | Ruark et al. | | |
| 8,347,972 | B2 | 1/2013 | Francis et al. | | |
| 8,444,109 | B2 | 5/2013 | Schaeper | | |
| 2008/0135791 | A1 * | 6/2008 | Juda et al. | 251/1.3 | |
| 2008/0265188 | A1 | 10/2008 | Springett et al. | | |
| 2009/0056132 | A1 | 3/2009 | Foote | | |
| 2010/0243926 | A1 | 9/2010 | Weir | | |
| 2012/0012339 | A1 | 1/2012 | Weir et al. | | |
| 2012/0012340 | A1 | 1/2012 | Ensley et al. | | |
| 2012/0193874 | A1 | 8/2012 | Melancon et al. | | |
| 2012/0241663 | A1 | 9/2012 | Wood | | |
| 2014/0183381 | A1 * | 7/2014 | Carbaugh | E21B 33/062 251/1.1 | |
| 2014/0264099 | A1 | 9/2014 | Melancon | | |

OTHER PUBLICATIONS

Weatherford, Automated Rig Equipment (2009-2012), 88 pages.

* cited by examiner

BLOWOUT PREVENTER WITH PACKER ASSEMBLY AND METHOD OF USING SAME

BACKGROUND

The present disclosure relates generally to techniques for performing wellsite operations. More specifically, the present disclosure relates to techniques, such as blowout preventers (BOPs), packers, and/or ram blocks, for sealing wellbores.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Tubing (or pipes) may be positioned in the wellbore to enable the passage of subsurface fluids to the surface.

Equipment, such as blowout preventers (BOPs), may be positioned about the wellbore to form a seal about the tubing therein to prevent leakage of fluid as it is brought to the surface. In some cases, the BOPs employ rams, ram blocks, and/or seals that engage a tubular in the wellbore and/or seal the wellbore. Examples of ram and/or ram blocks are provided in U.S. Patent/Application Nos. 2008/0265188, 2012/0012340, 2012/0012339, and 2010/0243926, the entire contents of which are hereby incorporated by reference herein.

SUMMARY

In at least one aspect, the disclosure relates to a packer assembly for a blowout preventer for sealing a wellbore. The blowout preventer has a housing for receiving a tubular and for receiving ram blocks. The ram blocks are movable between a non-engagement position a distance from the tubular and an engagement position about the tubular. Each of the ram blocks has a front face engageable with the front face of another of the ram blocks to form a seal therebetween. The packer assembly includes a face packer carried by the ram block and having a sealing surface engageable with the face packer of an adjacent ram block, and a pair of plates positionable about the face packer. The plates include an extended plate and a support plate with the face packer therebetween, and protrude a distance from the ram block beyond the support plate such that, when the ram blocks are moved together, the extended plate makes contact with the extended plate of an adjacent ram block before the support plates make contact whereby a sealing pressure between the face packers of the adjacent ram blocks is maintained.

The sealing surface of the face packer may have a vertical shape, a slanted shape, a rounded shape, and/or a trapezoidal shape. The extended plate may protrude from the ram block a distance beyond the sealing surface. The sealing surface may protrude from the ram block a distance beyond the support plate. The sealing surface may be recessed a distance behind the extended plate. The sealing surface may be perpendicular to a path of travel of the ram blocks. The support may have a rear portion and side portions. The support may include inserts disposable in the ram block. The face packer may receivingly engage the inserts. The face packer may include an elastomer and the plates may include metal.

In another aspect, the disclosure relates to a blowout preventer for sealing a wellbore having a tubular therein. The blowout preventer includes a housing to receive the tubular, ram blocks movably positionable in the housing between a non-engagement position a distance from the tubular and an engagement position about the tubular, and a packer assembly carried by each of the ram blocks. The ram blocks have a front face engageable with the front face of another of the ram blocks. The packer assembly includes a face packer carried by the ram block and having a sealing surface engageable with the face packer of an adjacent ram block, and a pair of plates positionable about the face packer. The plates including an extended plate and a support plate with the face packer therebetween. The extended plate protrudes from the ram block a distance beyond the support plate such that, when the ram blocks are moved together, the extended plate makes contact with the extended plate of an adjacent ram block before the support plates make contact whereby a sealing pressure between the face packers of the adjacent ram blocks is maintained.

The blowout preventer may also include a piston and cylinder, an actuator, a choke manifold, a top packer, and/or a control system. The ram block may have a groove to receive the face packer and/or a receptacle to receive the tubular.

Finally, in another aspect, the disclosure relates to a method of sealing a wellbore having a tubular therein. The method involves providing a blowout preventer including a housing, ram blocks, and packer assemblies. Each of the ram blocks has one of the packer assemblies. The packer assemblies include a face packer having a sealing surface engageable with the face packer of another of the ram blocks and a pair of plates positionable about the face packer. The pair of plates includes an extended plate and a support plate with the face packer therebetween, and protrudes a distance from the ram blocks beyond the support plate. The method further involves moving the ram blocks to an engagement position about the tubular, and forming a seal between the seal assemblies of the ram blocks by contacting the extended plates before contacting the support plates of the ram blocks and sealingly engaging the face packers.

The forming may involve contacting the face packers of the ram blocks before contacting the extended plates and/or shifting the plates by flowing the face packers thereabout in response to forces and pressures on the ram blocks. The method may also involve re-engaging the support plates when the support plates separate after the moving and/or locking the ram blocks.

BRIEF DESCRIPTION OF THE DRAWINGS

The drawings illustrate example embodiments of this disclosure and are, therefore, not to be considered limiting of its scope, for the disclosure may admit to other equally effective embodiments. The figures are not necessarily to scale, and certain features and certain views of the figures may be shown exaggerated in scale or in schematic in the interest of clarity and conciseness.

DETAILED DESCRIPTION

The description that follows includes exemplary apparatuses, methods, techniques, and instruction sequences that embody techniques of the present subject matter. However, it is understood that the described embodiments may be practiced without these specific details.

A blowout preventer (BOP) is positioned about a wellbore with a tubular of the wellbore extending therethrough. Ram blocks of the blowout preventer are movably positionable within the BOP to engage the tubular if a BOP event (e.g., leakage or blowout) occurs. Each of the ram blocks move together such that packer assemblies carried by the ram blocks surround the tubular and form a seal thereabout.

The packer assemblies include packers with sealing surfaces that form a seal with the packer of an adjacent ram block, and plates about the packer seal to support the packer as front faces of the ram blocks are pressed together into sealing engagement. The plates include an extended plate that protrudes beyond the support plate. The extended plates of the adjacent ram blocks make contact before the support plates to urge the packers together and maintain a seal even if the ram blocks retract and/or relax after moving and/or locking together.

The sealing assembly may be configured, for example, to manipulate the forces and pressure applied to the packer during sealing. For example, the sealing assembly may be used to prevent losses in force and/or pressure that may occur as the ram blocks are pressed together and/or a mechanical lock secures the ram blocks in place. Such losses may result from retraction, relaxation, and/or other movement of the ram blocks and/or portions thereof.

Figure 1:
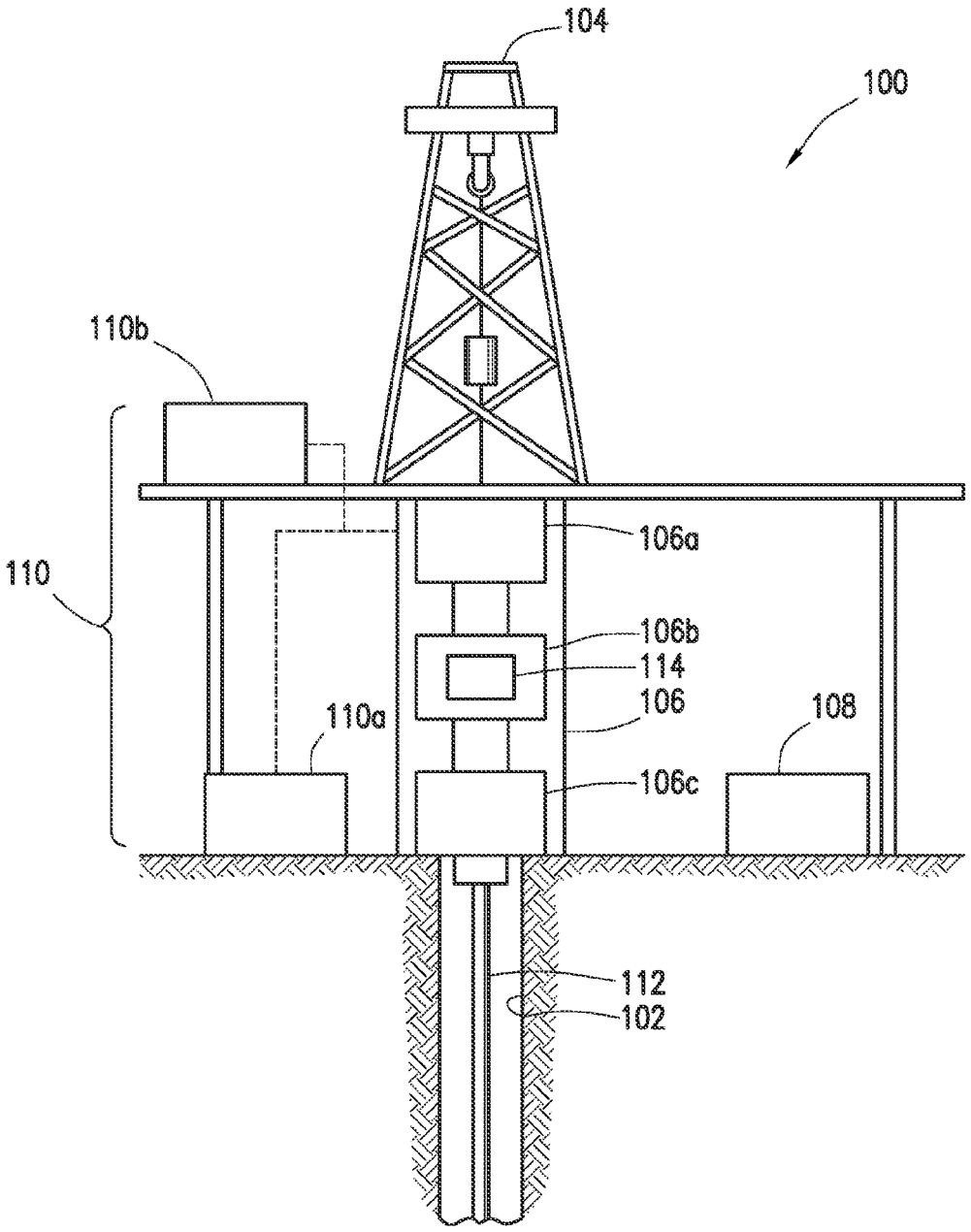
FIG. 1 shows a schematic view of a wellsite having a BOP with ram blocks with packer assemblies therein.

FIG. 1 depicts a wellsite 100 positionable about a wellbore 102. The wellsite 100 has a rig 104, a blowout preventer (BOP) 106, a choke manifold 108, and BOP control system 110 positioned about the wellbore 102. The BOP 106 is positioned about a tubing 112 extending from the wellbore 102 to the rig 104. The tubing 112 may be any tubing used with the wellbore 102, such as drill pipe, maintenance, or other tubing for performing operations at the wellsite.

The BOP 106 may include one or BOP portions therein, such as annular BOP 106*a*, double ram BOP 106*b*, and single ram BOP 106*c*. Examples of BOPs and related devices that may be used are provided in US Patent/Application Nos. 2008/0265188, 2012/0012340, 2012/0012339, and 2010/0243926, previously incorporated by reference herein.

The BOP 106 has the tubular 112 extending therethrough. One or more of various types of BOP portions may be provided in the BOP 106 to engage (e.g., seal, shear, and/or sever) the tubular 112. One or more of the BOPs 106*a-c* may be provided with ram assemblies 122 for forming the seal about the tubular 112. The BOP 106 may also be provided with other devices, such as a drilling spool, manual gate valve, hydraulic gate valve, check valve, and/or other devices.

The choke manifold 108 may be operatively connected to the BOP 106 to provide fluid under pressure to the BOP 106. The choke manifold 108 may include, for example, a transmitter, pressure gauge, manual gate valve, hydraulic gate valve, drilling choke, and/or other devices.

The BOP control system 110 may be coupled to the BOP 106, choke manifold 108, and/or other equipment at the wellsite 100 to control operation thereof. The BOP control system 110 may include a BOP control unit 110*a* and a pressure control unit 110*b*. The BOP control unit 110*a* may include, for example, a choke control console, standpipe pressure gauges, and/or other devices. The pressure control unit 110*b* may include, for example, a closing unit, pipe rack, remote control panel, and/or other devices.

To operate one or more ram assemblies 122 and/or other devices associated with the wellsite 100, the BOP control system 110 and/or other controller may be placed in communication therewith. The BOP control system 110 may communicate by any suitable communication means, such as hydraulic lines, pneumatic lines, wiring, fiber optics, telemetry, acoustics, wireless communication, any combination thereof, and the like. The BOP 106, choke manifold 108, ram assemblies 122, and/or other devices at the wellsite 100 may be automatically, manually and/or selectively operated via the BOP control system 110.

Figure 2A:
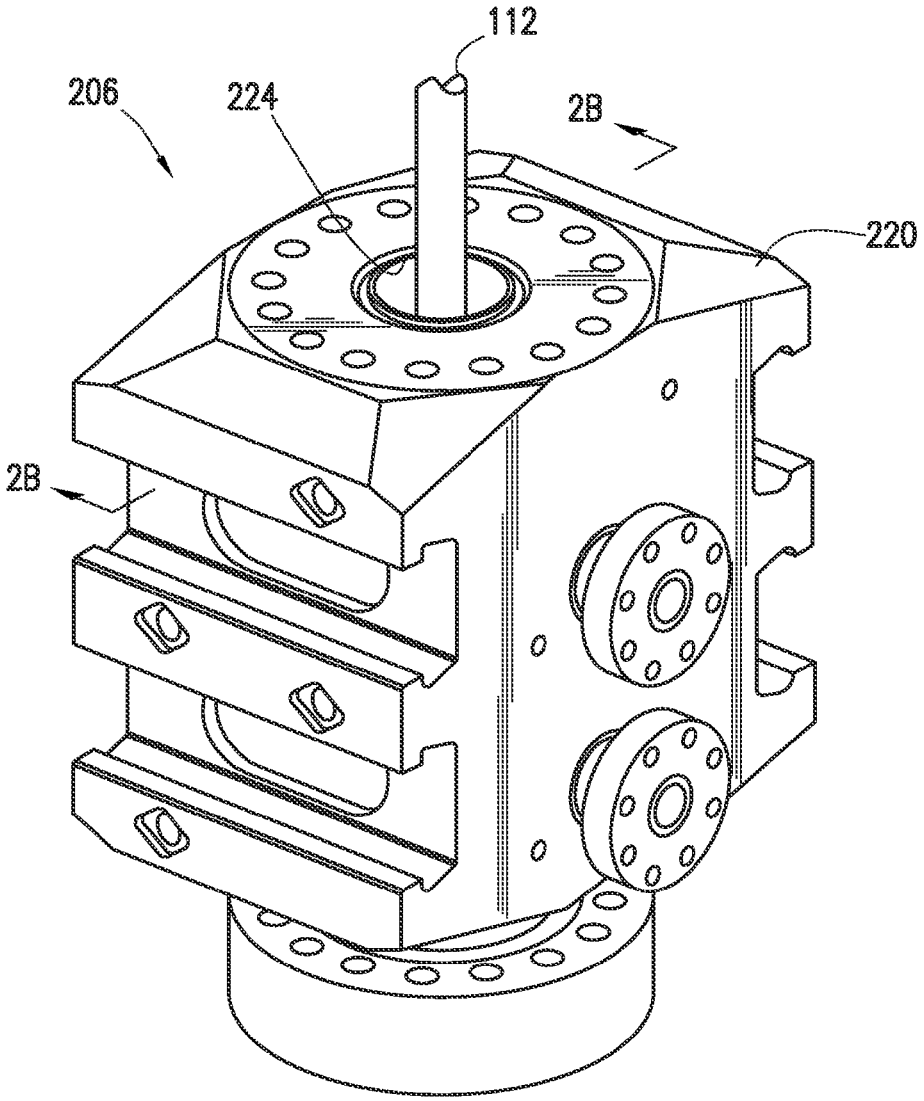
FIGS. 2A and 2B show perspective and cross-sectional views, respectively, of a BOP with ram blocks with packer assemblies therein.
Figure 2B:
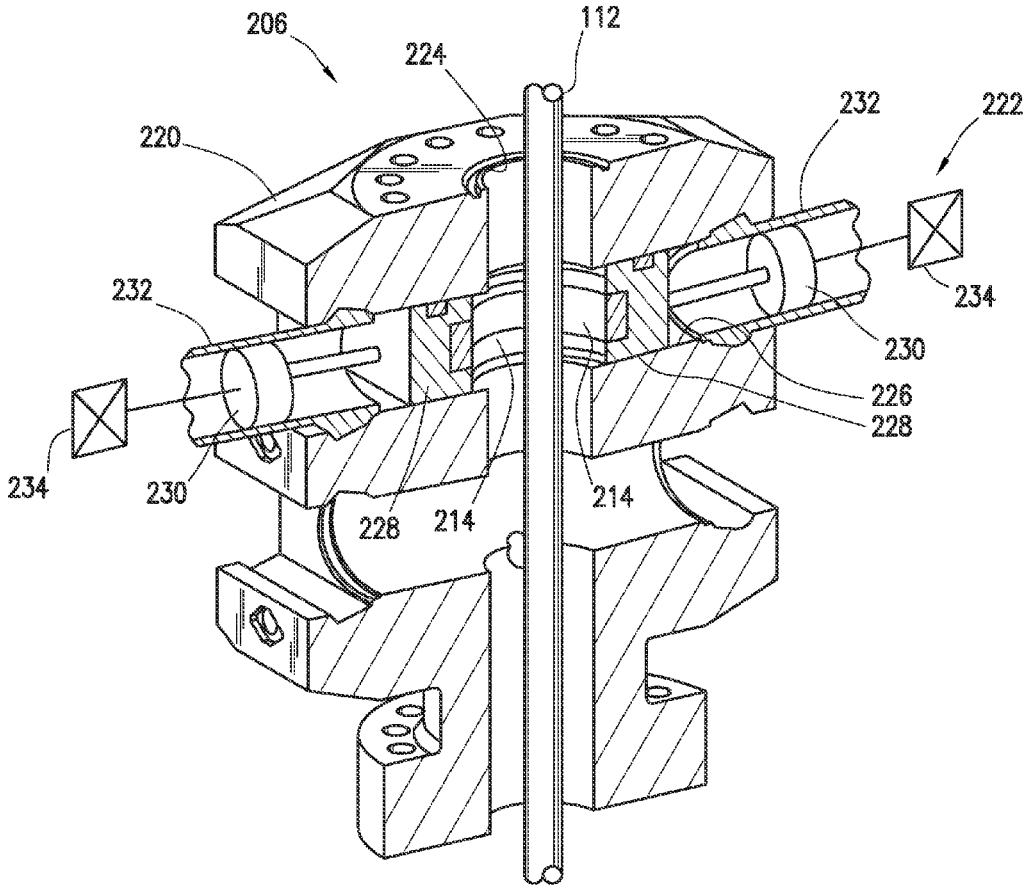

FIGS. 2A and 2B show an example BOP 206 that may be used as the BOP 106 and/or BOP portions 106*a-c*. FIG. 2A shows a perspective view of the BOP 206. FIG. 2B shows a cross-sectional view of the BOP 206 of FIG. 2A taken along line 2B-2B.

The BOP 206 includes a housing 220 and ram assemblies 222. The housing 220 has a bore 224 therethrough to receive the tubing 112, and channels 226 therethrough to slidingly receive the ram assemblies 222. The ram assemblies 222 include ram blocks 228, pistons 230, cylinders 232, and actuators 234. The ram blocks 228 are slidably positionable in the channels 226. The ram blocks 228 are extendable and retractable in the channels 226 by pistons 230 and cylinders 232. Actuators 234 may be used to drive the pistons 230 about the cylinders 232.

The ram blocks 228 are movable between a retracted position a distance from the tubing 112 and an extended position. In the extended position, the ram blocks 228 are positioned in sealing engagement about the tubing 112. The ram blocks 228 carry packer assemblies 214. The packer assemblies 214 of adjacent ram blocks 228 are engageable when the ram blocks 228 are moved to the extended position. The packer assemblies 214 of each ram block 228 are positionable in sealing engagement about the tubular 112.

Figure 3:
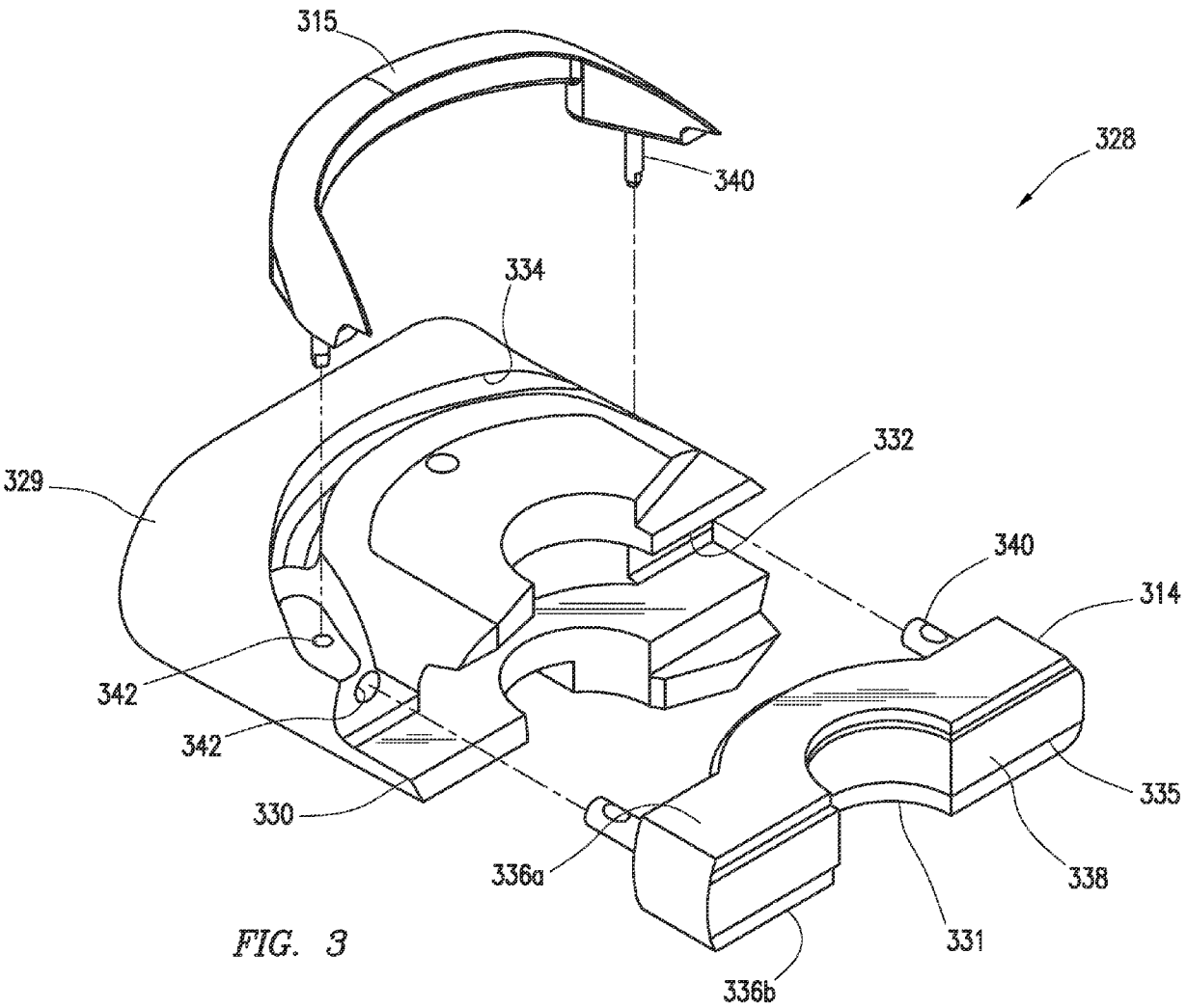
FIG. 3 shows an exploded view of a ram block with a packer assembly therein.

FIG. 3 is an exploded view of an example ram block 328 usable with the BOPs herein. The ram blocks 328 each has a base 329 with a front packer assembly 314 and a top seal 315. The top seal 315 and front packer assembly 314 each have inserts 340 receivable in holes 342 in the ram block 328. The top of the ram block 328 may have a top groove 334 extending therein to receive the top seal 315. The top seal 315 may be engageable with the housing 220 along the channels 226 (FIG. 2B) to form a seal therewith. The top seal 315 may remain compressed to form the seal with the BOP 206.

The front packer assembly 314 is provided about a front face 330 of the ram block 328. The front packer assembly 314 is receivable in a groove 332 about the front face 330 of the ram block 328. One or more grooves may be provided about the ram block 328 to receive one or more various types of seals, packers and/or packer assemblies.

The front packer assembly 314 defines a sealing surface 335 about the front face 330 of the ram block 328 for sealing engagement with the sealing surface 335 of an adjacent ram block 328 when the ram blocks 328 come together as shown in FIG. 2B. The sealing surfaces 335 of the front packer assemblies 314 of adjacent rams 328 engage to form a seal therebetween. The seal may be formed when the ram blocks 328 close together with some force therebetween to generate the seal and block fluid under pressure.

Figure 4A:
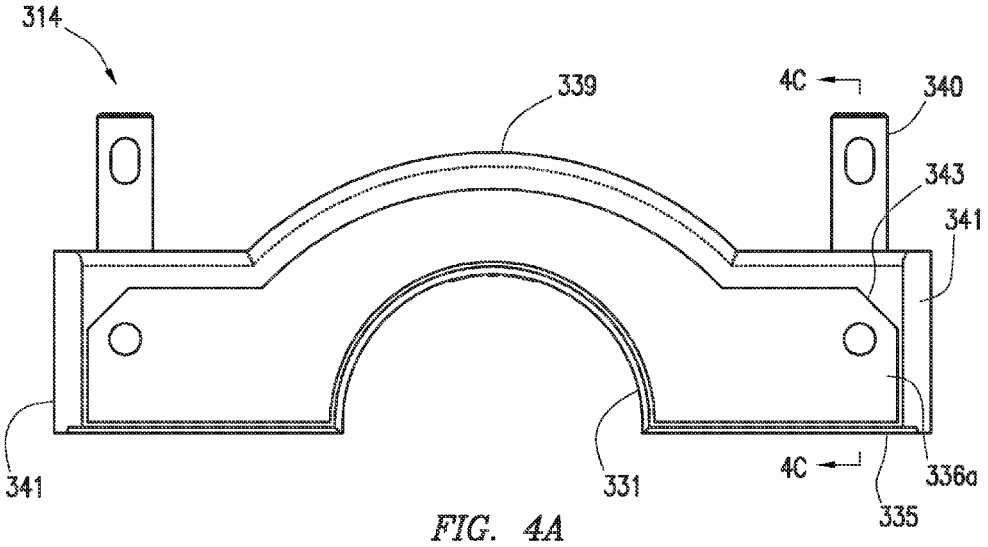
FIGS. 4A-4C show top, perspective, and cross-sectional views, respectively, of the packer assembly of FIG. 3.
Figure 4B:
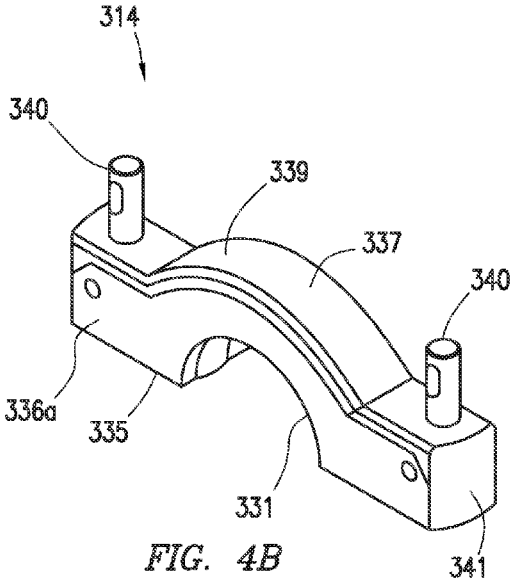
Figure 4C:
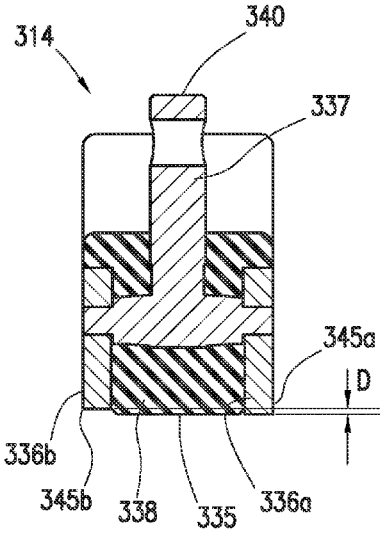

FIGS. 3 and 4A-4C show various views of the front packer assembly 314. FIG. 4A shows a top view, FIG. 4B shows a perspective view, and FIG. 4C is a cross-sectional view along line 4C-4C of the front packer assembly 314. The front packer assembly 314 includes a packer support 337, an extended plate 336*a*, a support plate 336*b*, and a face packer 338. The face packer 338 may be made of, for example, an elastomeric material. The plates 336*a,b* and support 337 may be made of, for example, a metallic material. The plates 536*a-b* may be flat plates extending a distance into the face packer 338 and supported thereby.

The packer support 337 is receivable in the groove 332 and has the inserts 340 thereon positionable in the holes 342. The packer support 337 carries the face packer 338. As shown, the packer support 337 may have a rear portion 339 with sides 341 extending therefrom to define a packer cavity 343 to receive the face packer 338. The inserts 340 may extend through the rear portion 339 and be embedded within the face packer 338.

The face packer 338 is supported by the packer support 337 between the extended plate 336*a* and the support plate 336*b*. The face packer 338 has the sealing surface 335 therealong. As shown, the sealing surface 335 is a generally vertical surface parallel to the bore 224 of the BOP 206 (FIG. 2A). The sealing surface 335 of the ram block 328 is engageable with the sealing surface 335 of an adjacent ram block 328 to form a seal therewith. The sealing surface 335 aligns with the front face 330 of the ram block 326. As shown, the front face and sealing surface have a receptacle 331 extending therein to receive the tubular 112 (FIG. 2B).

As shown in FIGS. 2B and 4C, the face packer 338 has the sealing surface 335 thereon that faces the tubular 112 and the face packer 338 of the opposing ram block 328. The extended plate 336*a* and support plate 336*b* have a contact end 345*a,b* adjacent the sealing surface 335. The contact ends 345*a,b* are engageable with contact ends 345*a,b* of the adjacent ram block 328. As shown in FIG. 4C, the contact end 345*a* of the extended plate protrudes a distance D further than the support plate 336*b* towards the tubular 112.

FIGS. 5A-5E are schematic diagrams depicting cross-sectional views of portions of various versions of a packer assembly 514*a-d* usable with ram blocks as described herein. As shown in these views, the packer assemblies 514*a-d* may be provided with various shapes of face packers 538*a-d* positioned between extended plates 536*a* and support plates 536*b*. In each version, end 545*a* of each extended plate 536*a* projects the distance D beyond a vertical plane Y defined by end 545*b* of each of the support plates 536*b*. The vertical plane Y is parallel to the bore 224 of the BOP 206 (FIG. 2A) and extends about sealing surfaces 535*a-e*2 of each face packer 538*a-d*.

Each of the face packers 538*a-d* have the plates 536*a,b* extending therein on opposite (e.g., uphole and downhole) sides thereof. The face packer 538*a-d* may have varied thicknesses for receiving the plates 536*a,b*. The face packers 538*a-d* may have a sealing surface 535*a-d* engageable with the sealing surface 535*a-d* of an adjacent packer assembly 514*a-d*.

Figure 5A:
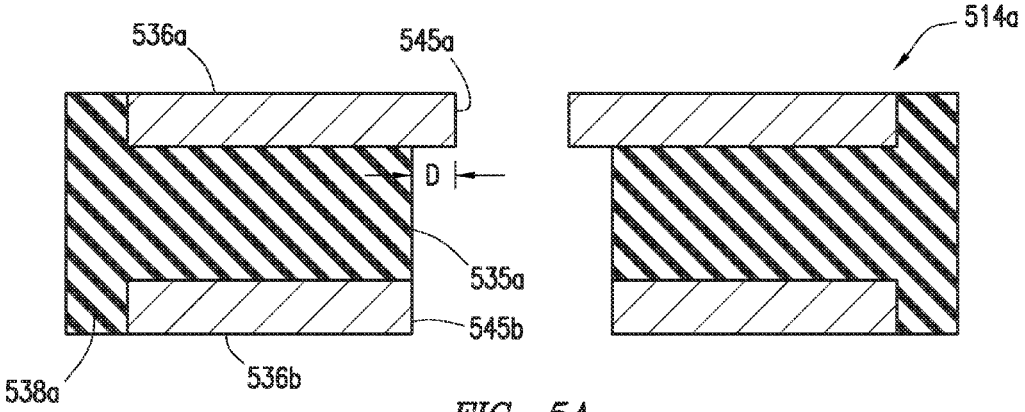
FIGS. 5A-5E show cross-sectional views of various packer assembly configurations.
Figure 5B:
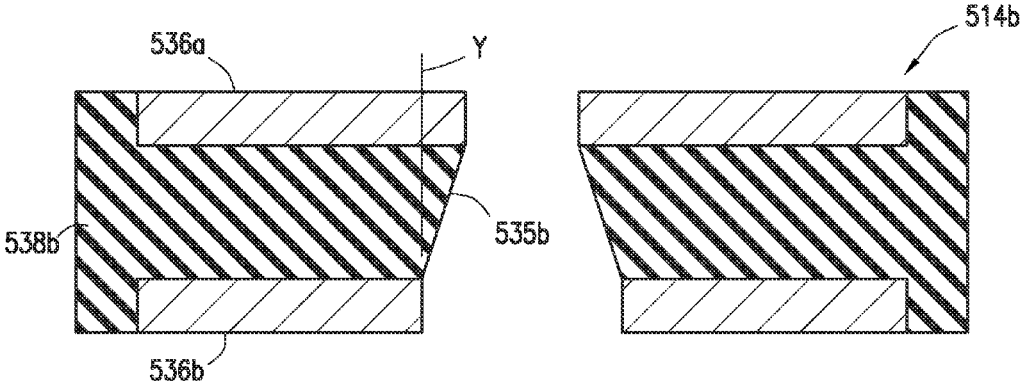
Figure 5C:
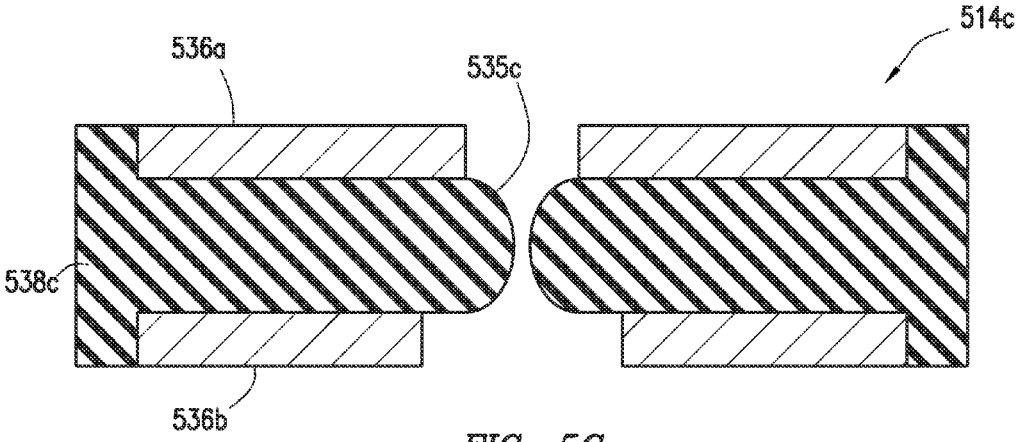
Figure 5D:
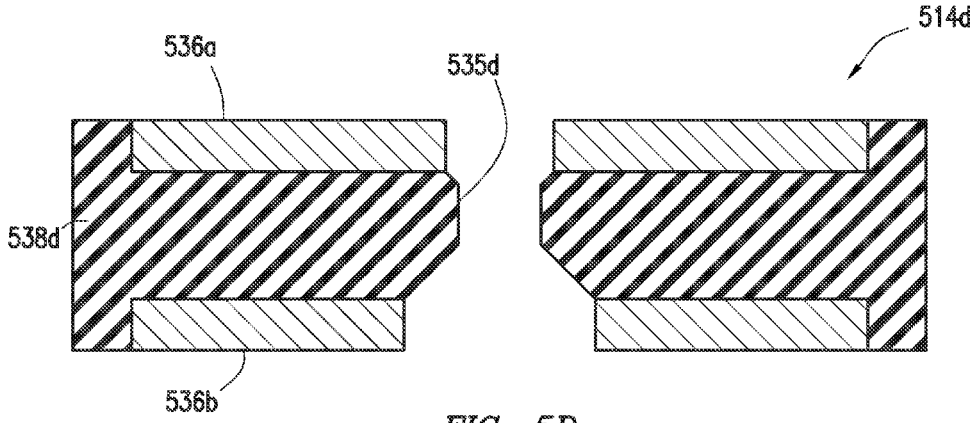
Figure 5E:
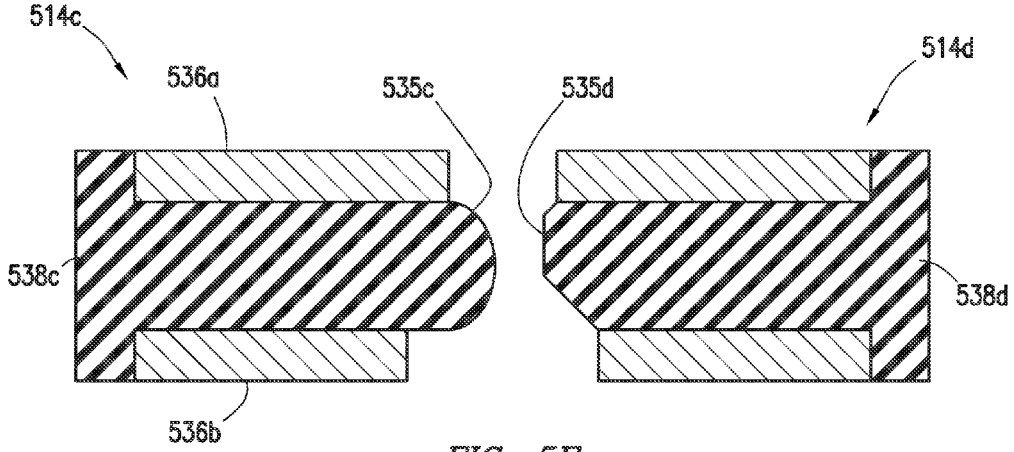

As also shown in FIGS. 5A-5C, the face packers 538*a-d* may have different shapes. The face packers 538*a-d* each have vertical, angled, rounded, and trapezoidal shaped sealing faces 535*a-d*, respectively. As shown by FIG. 5A-5D, the face packers of adjacent packer assemblies may be the same. As shown by FIG. 5E, the face packers of adjacent packer assemblies may be different. In FIG. 5E, the seal assembly 514*c* is positioned for sealing engagement with the different seal assembly 514*d*.

In FIG. 5A, the vertical face packers 538*a* has a vertical sealing surface 535*a* that is flush with the support plate 536*b* and a distance D behind the extended plate 536*a*. In FIG. 5B, the angled sealing surface 535*b* tapers from the extended plate 536*a* to the recessed support plate 536*b*. In FIG. 5C, the rounded sealing surfaces 535*c* are curved and extend from the extended plate 536*a* to the support plate 536*b*. In FIG. 5D, the trapezoidal face sealing surface 535*d* has an angled surface extending from the extended plate 536*a* to the support plate 536*b*.

As shown in FIGS. 5A and 5B, the sealing surfaces 535*a,b* may recess behind the extended plate 536*a*. The sealing surface 535*a* may be flush with the support plate 536*a* as shown in FIG. 5A or extend beyond the support plate 536*b* as shown in FIG. 5B. As shown in FIGS. 5C-5E, the sealing surfaces 535*c-d* may project beyond the extended plate 536*a*.

FIGS. 6A-6F are schematic, cross-sectional views of a ram assembly 622 with the ram blocks 628 in various positions during operation thereof. These figures depict the ram blocks 628 as they move from a retracted position to an extended position for engagement about a tubular (e.g., 112 of FIG. 2B). Each of the ram blocks 628 carries a sealing assembly 614.

Figure 6A:
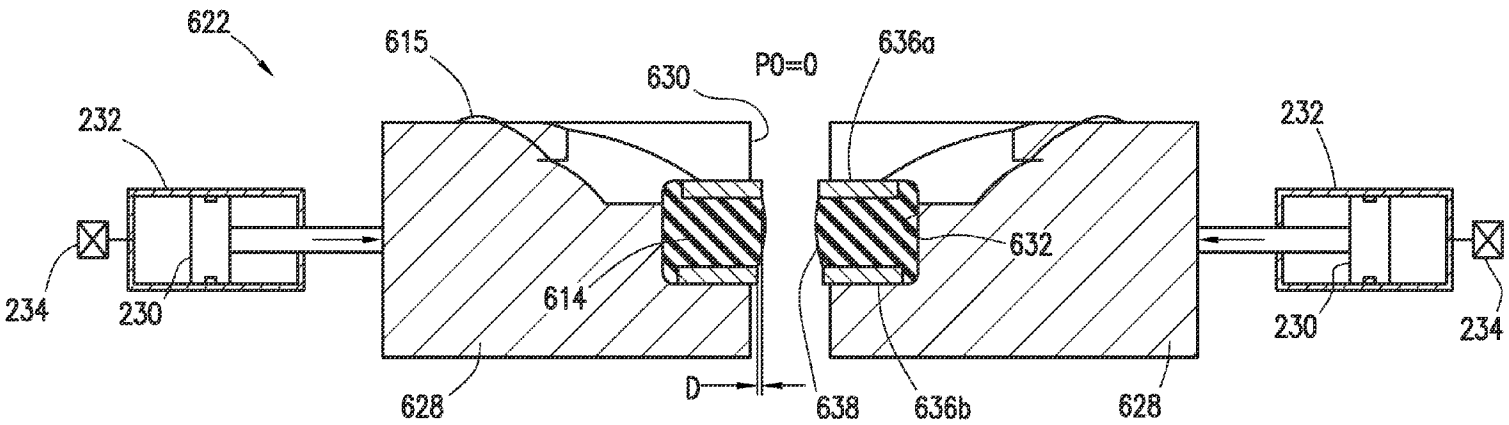
FIGS. 6A-6F are schematic, cross-sectional views of ram blocks with packer assemblies therein in various positions during operation.

As shown in FIG. 6A, the ram blocks 628 are driven by pistons 230 and cylinders 232 and actuators 234. The ram blocks 628 have the front packer assemblies 614 and top seals 615 therein. The front packer assemblies 614 may be any of the packer assemblies described herein. As shown, the packer assemblies 614 include an extended plate 636*a* and a support plate 636*b* with face packer 638 therebetween. The extended plate 636*a* extends a distance D further from the ram block 628 than the support plate 636*b*.

In a start position of FIG. 6A, the pistons 230 are activated to initiate movement of the ram blocks 628 from the retracted position toward the extended (or sealed) position. At this point, a front end 630 and face packers 638 of the ram blocks 628 are in non-contact and have no pressure thereon. A rear 632 of the packer assembly 614 is positioned adjacent to the ram block 628. The pressure about the face packer 638 of the packer assembly 614 is at a base level of P0=0.

Figure 6B:
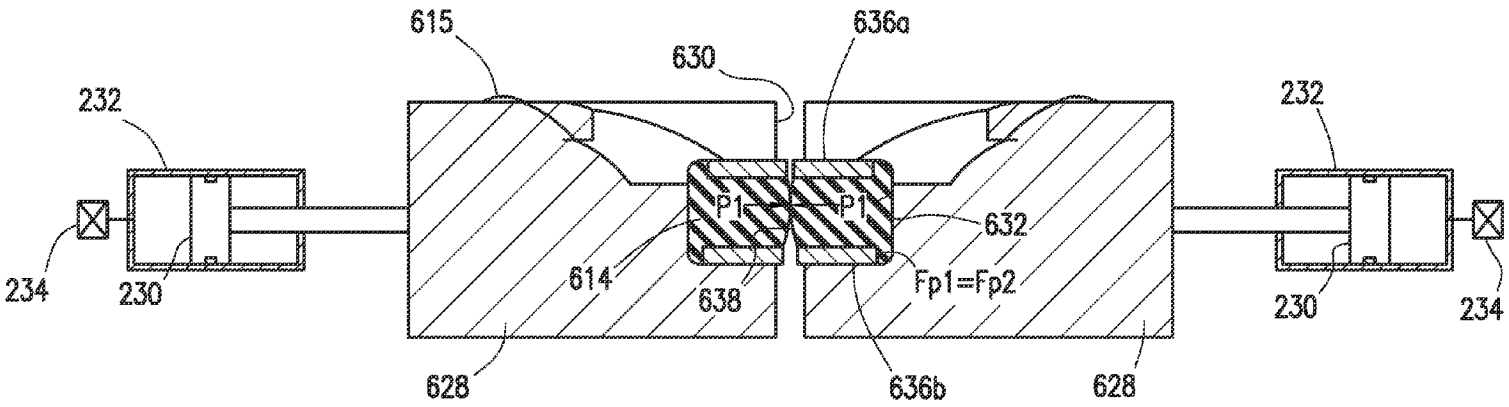

In an initial contact position of FIG. 6B, the ram blocks 628 have moved together such that the face packers 638 have made initial contact. The face packers 638 engage and apply a pressure P1 thereon. The forces of the rubber apply forces Fp1 and Fp2 to the plates 636*a,b*. Because the plates 636*a,b* are in a non-contact position, the plates 636*a,b* have the same force Fp1=Fp2. The forces and pressure drive the face packers 638 to press against a rear end of the plates 636*a,b* to push the plates towards one another.

Figure 6C:
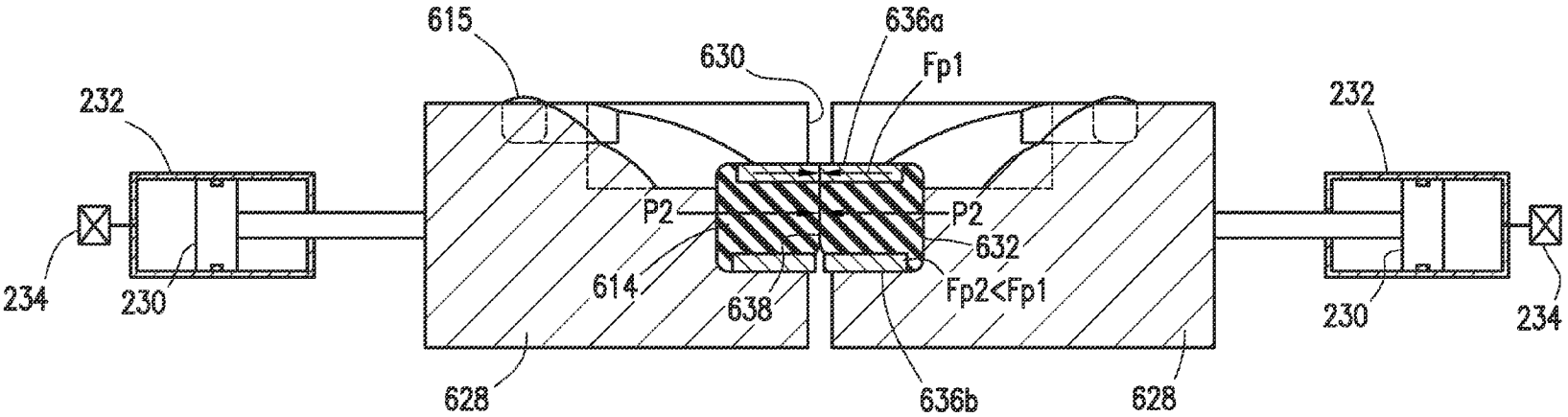

In a partially closed position of FIG. 6C, the ram blocks 628 have moved together such that the extended plates 636*a* have made contact. The pressure between the face packers 638 has increased to a pressure P2. The forces on the face packers 638 apply forces Fp1 and Fp2 to the plates 636*a,b*. Because the extended plates 636*a* are in a contact position, the extended plates 636*a* have a force greater than the support plates 636*b* Fp1>Fp2. The forces and pressure drive the face packers 638 to press against a rear end of the support plates 636*b* to push the support plates 636*b* towards one another.

Figure 6D:
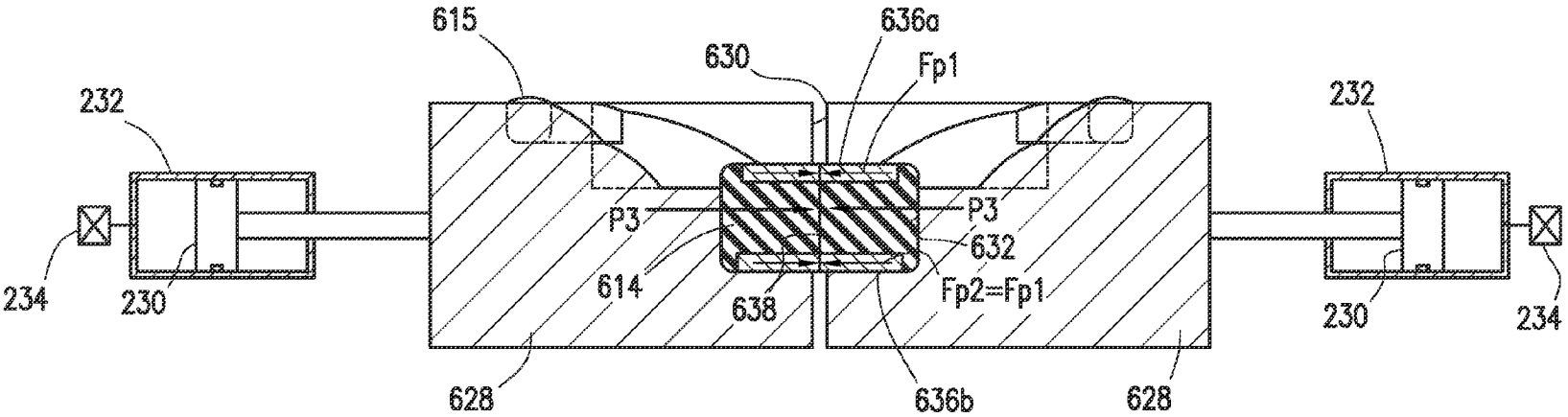

In a fully closed position of FIG. 6D, the ram blocks 628 have moved together such that the face packers 638 and both plates 636*a,b* have made contact. The pressure between the face packers 638 has increased to a pressure P3. Because the extended and support plates 636*a,b* are both in contact, the same force Fp1 and Fp2 are applied to the plates 636*a,b* resulting in equal forces Fp1=Fp2 therebetween. The Fp1 and Fp2 forces and pressure P3 are increased from those of FIG. 6C.

Figure 6E:
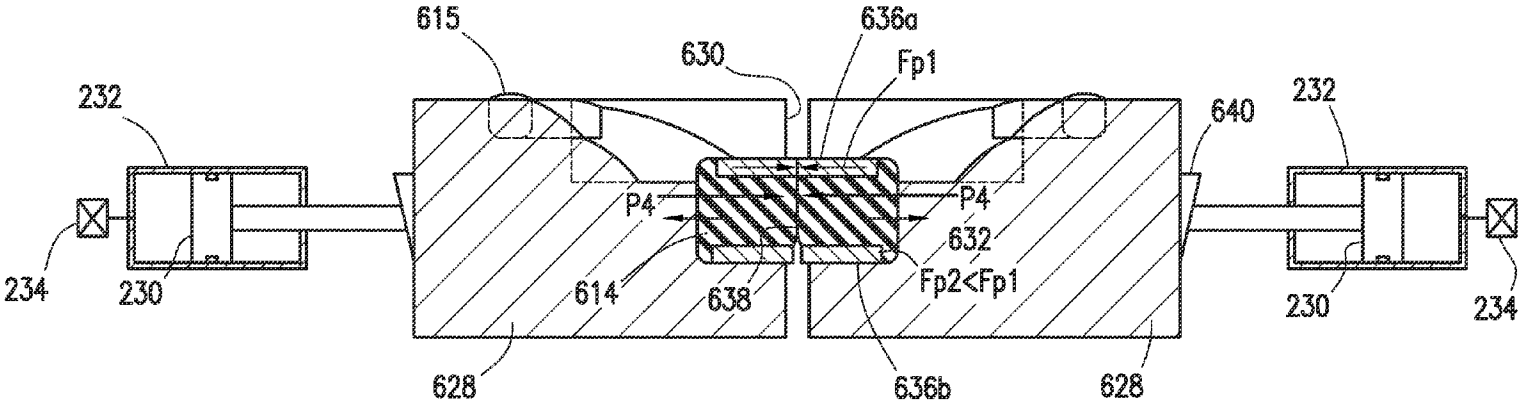

In a stopped position of FIG. 6E, the ram blocks 628 have stopped moving together. The pistons 230 may be locked in place by locks 640 to prevent further movement. Following the cessation of movement of the pistons 230, the ram blocks may experience a relaxation or slight retraction as indicated by the arrows. This relaxation permits the face packers 614 to retract slightly such that the support plates 636*b* may move to a partially non-contact position.

The pressure P4 may reduce below the pressure P3 of FIG. 6D and the forces Fp1 and Fp2 may be altered. With the extended plates 636*a* in a contact position and the support plates 636*b* in a non-contact position, the force Fp2 of the support plates 636*b* is less than the extended plates 636*a*. As indicated by the arrows, the force Fp2 of the support plate 636*b* retracts the plates 636*b* and pushes the face packers 638 and extended plates 636*a* together.

During the transition from the closed position of FIG. 6D to a stopped position of FIG. 6E, the forces that drives the rams blocks 628 together and the pressures Fp1 and Fp2 may reduce. The losses in pressure may be synonymous with loss of contact between the face packers 638.

Figure 6F:
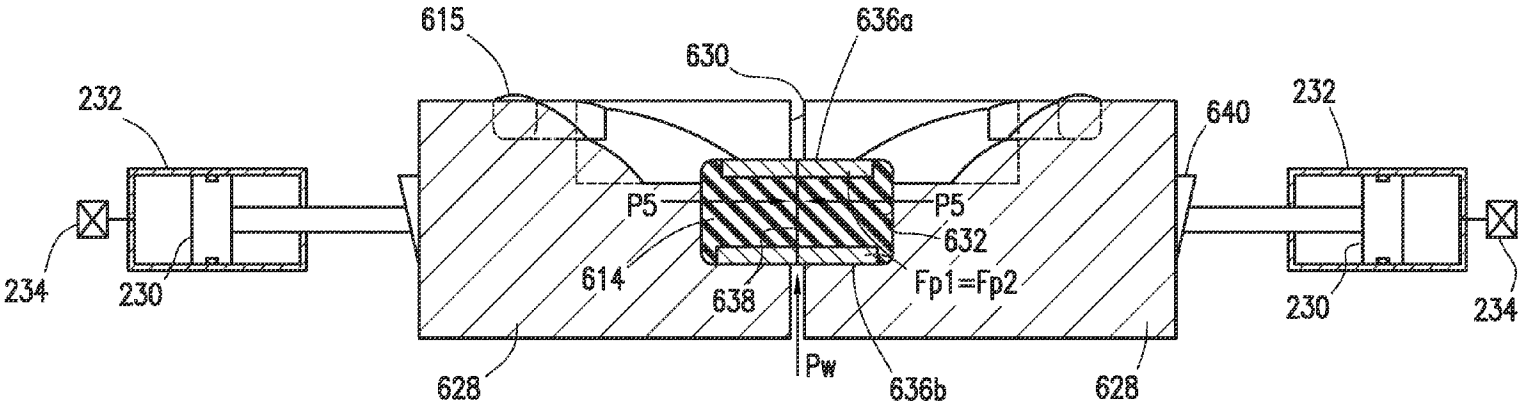

In the locked and sealed position of FIG. 6F, the ram blocks 628 have moved together such that the face packers 614 and both plates 636*a,b* have made contact. The pressure between the face packers 638 has increased to a pressure P5. Because the uphole and support plates 636*a,b* are both in contact, about the same force Fp1 and Fp2 are applied to the plates 636*a,b* resulting in substantially equal forces Fp1≈Fp2 therebetween. The forces and pressure between the ram blocks 628 may increase higher than the pressure P3 of FIG. 6D such that P5>P3,P4.

A wellbore pressure is also applied from the wellbore as indicated by the arrow Pw. The wellbore pressure Pw applies a force vertically on the rams 628 from below and horizontally forces rams 628 together. These forces effectively increase the pressure on the ram blocks 628.

Figure 7:
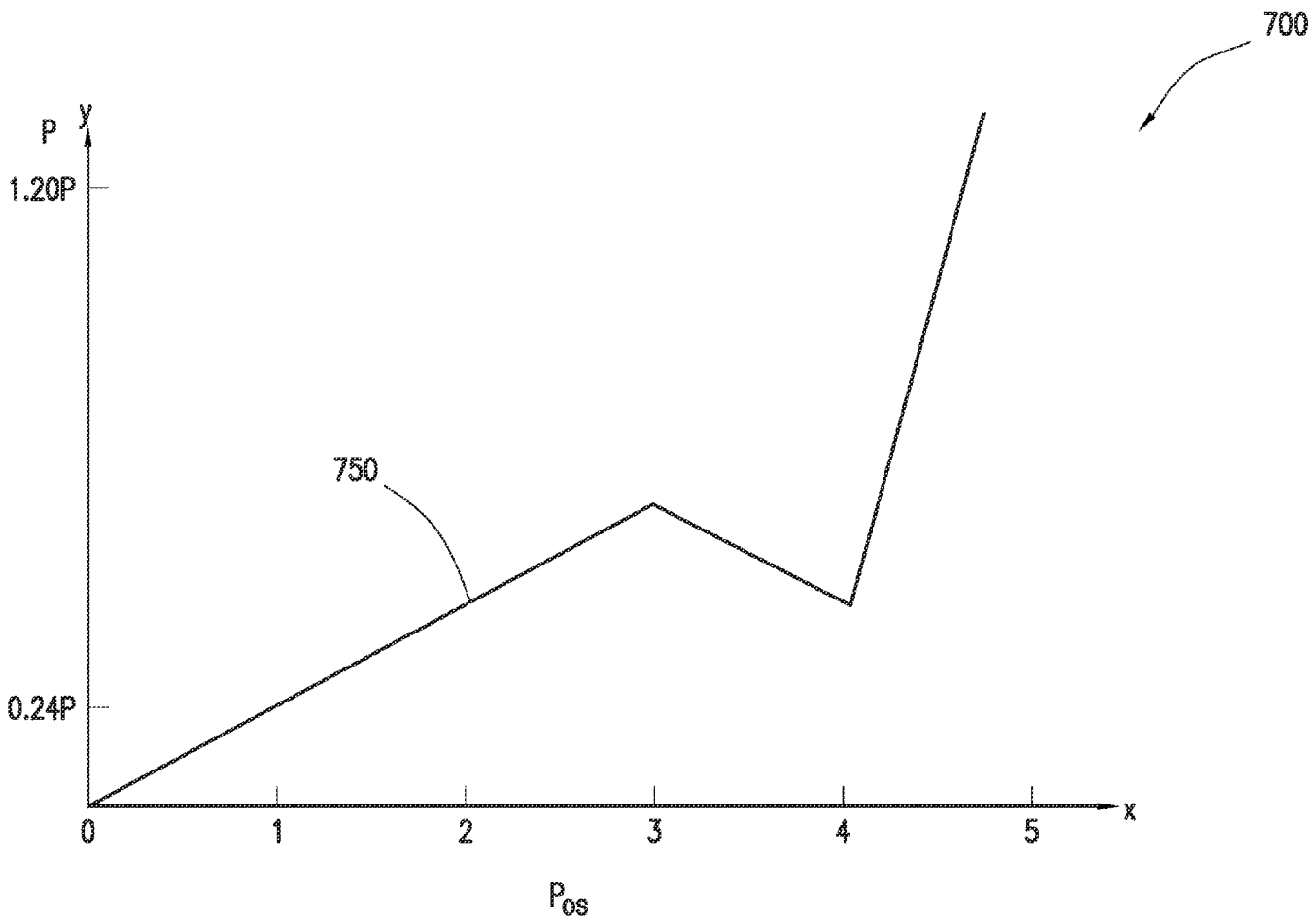
FIG. 7 is a graph depicting force on the packer assembly during operation.

FIG. 7 is a graph 700 depicting pressure on the face packers 614 in each of the positions of FIGS. 6A-6F. The graph 700 depicts pressure P (y-axis) versus position POS (x-axis). As shown by line 750, the pressure P increases from the start position at Pos 0 (FIG. 6A), the initial contact at Pos 1 (FIG. 6B), the partially closed at Pos 2 (FIG. 6C), the fully closed at Pos 3 (FIG. 6D), the stopped at Pos 4 (FIG. 6E), and locked and sealed at Pos 5 (FIG. 6F). The configuration of the packer assembly 615 may be used to rebound pressure losses as indicated by the line 750.

Figure 8:
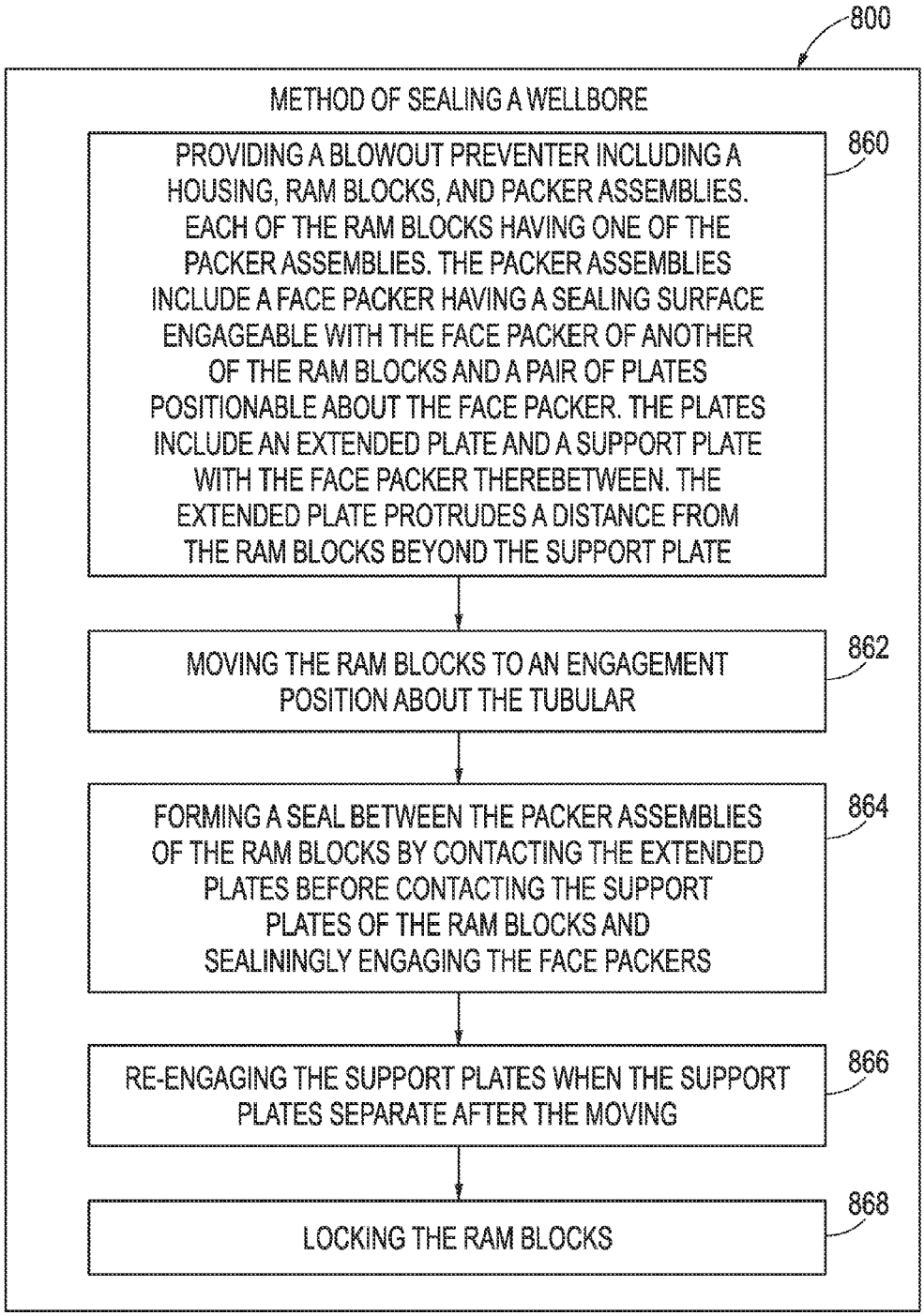
FIG. 8 is a flow chart depicting a method of sealing a wellbore.

FIG. 8 shows a method 800 for sealing the wellbore 102. The method 800 involves 860 providing a blowout preventer including a housing, ram blocks, and packer assemblies. Each of the ram blocks having one of the packer assemblies. The packer assemblies include a face packer having a sealing surface engageable with the face packer of another of the ram blocks and a pair of plates positionable about the face packer. The plates include an extended plate and a support plate with the face packer therebetween. The extended plate protrudes a distance from the ram blocks beyond the support plate.

The method further involves 862 moving the ram blocks to an engagement position about the tubular, and 864 forming a seal between the packer assemblies of the ram blocks by contacting the extended plates before contacting the support plates of the ram blocks and sealiningly engaging the face packers. The method may also involve 866 re-engaging the support plates when the support plates separate after the moving and 868 locking the ram blocks.

The forming may involve contacting the face packers of the ram blocks before contacting the extended plates and/or shifting the plates by flowing the face packers thereabout in response to forces and pressures on the ram blocks. The method may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the present disclosure describes specific aspects of the subject matter, numerous modifications and variations will become apparent to those skilled in the art after studying the disclosure, including use of equivalent functional and/or structural substitutes for elements described herein. For example, aspects of the subject matter can also be implemented for operation in combination with various configurations of BOPs, rams, actuators, packer assemblies, plates, and/or face packers. All such similar variations apparent to those skilled in the art are deemed to be within the scope of the disclosure as defined by the appended claims.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A packer assembly for a blowout preventer for sealing a wellbore, the blowout preventer having a housing for receiving a tubular and for slidingly receiving ram blocks, each of the ram blocks having a front face engageable with the front face of another of the ram blocks to form a seal therebetween, the packer assembly comprising:

a face packer carried by the ram block, the face packer having a sealing surface engageable with the face packer of the another ram block; and a pair of plates positionable about the face packer, the pair of plates comprising an extended plate and a support plate with the face packer therebetween, the extended plate protruding from the ram block a distance beyond the support plate such that, when the ram blocks are moved together, the extended plate makes contact with the extended plate of an adjacent ram block before the support plates make contact whereby a sealing pressure between the face packers of the adjacent ram blocks is maintained.

2. The packer assembly of claim 1, wherein the sealing surface of the face packer has one of a vertical shape, a slanted shape, a rounded shape, a trapezoidal shape, and combination thereof.

3. The packer assembly of claim 1, wherein the extended plate protrudes from the ram block a distance beyond the sealing surface.

4. The packer assembly of claim 1, wherein the sealing surface protrudes from the ram block a distance beyond the support plate.

5. The packer assembly of claim 1, wherein the sealing surface is recessed a distance behind the extended plate.

6. The packer assembly of claim 1, wherein the sealing surface is perpendicular to a path of travel of the ram blocks.

7. The packer assembly of claim 1, further comprising a support carried by the ram block and receiving the packer assembly.

8. The packer assembly of claim 7, wherein the support comprises inserts disposable in the ram block.

9. The packer assembly of claim 8, wherein the face packer receivingly engages the inserts.

10. The packer assembly of claim 1, wherein the face packer comprises an elastomer and the pair of plates comprise metal.

11. A blowout preventer for sealing a wellbore having a tubular therein, the blowout preventer comprising:

a housing to receive the tubular;

ram blocks movably positionable in the housing between a non-engagement position a distance from the tubular and an engagement position about the tubular, each of the ram blocks having a front face engageable with the front face of another of the ram blocks; and a packer assembly carried by each of the ram blocks, the packer assembly comprising:

a face packer carried by the each of the ram blocks, the face packer having a sealing surface engageable with the face packer of the another ram block; and a pair of plates positionable about the face packer, the pair of plates comprising an extended plate and a support plate with the face packer therebetween, the extended plate protruding from the ram block a distance beyond the support plate such that, when the ram blocks are moved together, the extended plate makes contact with the extended plate of an adjacent ram block before the support plates make contact whereby a sealing pressure between the face packers of the adjacent ram blocks is maintained.

12. The blowout preventer of claim 11, further comprising a piston and cylinder.

13. The blowout preventer of claim 11, further comprising an actuator.

14. The blowout preventer of claim 11, further comprising a choke manifold.

15. The blowout preventer of claim 11, further comprising a control system.

16. The blowout preventer of claim 11, wherein the ram block has a groove to receive the face packer.

17. The blowout preventer of claim 11, wherein the ram block has a receptacle to receive the tubular.

18. The blowout preventer of claim 1, wherein the ram block further comprises a top packer.

19. A method of sealing a wellbore having a tubular therein, the method comprising:

providing a blowout preventer comprising a housing, ram blocks, and packer assemblies, each of the ram blocks having one of the packer assemblies, the packer assemblies comprising a face packer having a sealing surface engageable with the face packer of another of the ram blocks and a pair of plates positionable about the face packer, the pair of plates comprising an extended plate and a support plate with the face packer therebetween, the extended plate protruding a distance from the ram blocks beyond the support plate;

moving the ram blocks to an engagement position about the tubular; and forming a seal between the seal assemblies of the ram blocks by contacting the extended plates before contacting the support plates of the ram blocks and sealiningly engaging the face packers.

20. The method of claim 1, wherein the forming comprises contacting the face packers of the ram blocks before contacting the extended plates.

21. The method of claim 1, wherein the forming comprises shifting the plates by flowing the face packers thereabout in response to forces and pressures on the ram blocks.

22. The method of claim 1, further comprising re-engaging the support plates when the support plates separate.

23. The method of claim 1, further comprising locking the ram blocks.

* * * * *